US007431092B2

(12) United States Patent
Håheim et al.

(10) Patent No.: US 7,431,092 B2
(45) Date of Patent: Oct. 7, 2008

(54) ASSEMBLY AND METHOD FOR INTERVENTION OF A SUBSEA WELL

(75) Inventors: Svein Audun Håheim, Oslo (NO); Edgar Johan Heim, Stavanger (NO); Sturla Wold, Stavanger (NO); Christopher Hoen, Gjettum (NO)

(73) Assignee: Vetco Gray Scandinavia AS, Billingstad (NO)

( * ) Notice: Subject to any disclaimer, the term of this patent is extended or adjusted under 35 U.S.C. 154(b) by 258 days.

(21) Appl. No.: 10/519,145

(22) PCT Filed: Jun. 30, 2003

(86) PCT No.: PCT/IB03/03084

§ 371 (c)(1),
(2), (4) Date: Oct. 7, 2005

(87) PCT Pub. No.: WO2004/003338

PCT Pub. Date: Jan. 8, 2004

(65) Prior Publication Data

US 2006/0124314 A1 Jun. 15, 2006

Related U.S. Application Data

(60) Provisional application No. 60/449,613, filed on Feb. 26, 2003.

(30) Foreign Application Priority Data

Jun. 28, 2002 (NO) ..... 20023178

(51) Int. Cl.
*E21B 29/12* (2006.01)

(52) U.S. Cl. ..... 166/343; 166/85.1; 166/77.2

(58) Field of Classification Search ..... 166/343, 166/345, 335, 378, 85.1, 77.1–77.4
See application file for complete search history.

(56) References Cited

U.S. PATENT DOCUMENTS 4,899,823 A 2/1990 Cobb et al.

(Continued)

FOREIGN PATENT DOCUMENTS

EP 0380148 A1 8/1990

(Continued)

*Primary Examiner*—Thomas A Beach
(74) *Attorney, Agent, or Firm*—Venable LLP; Eric J. Franklin

(57) ABSTRACT

A well assembly for intervention of a subsea well or a well head with a wireline or a coiled tubing connected to a tool or a toolstring and including lubricator and an injector package. The injector package is adapted to inject the wireline or coiled tubing into the well or well head. The lubricator is adapted to be fitted in a lubricator package and define a locking chamber via which the wireline or coiled tubing is to be forwarded to the well or well head. The lubricator is adapted to be connected to the well head. The injector package includes an injector module adapted to be fitted to the well head. The injector module is adapted to forward the lubricator through it when the packages are connected to each other and to the well head, for the purpose of injecting the wireline or coiled tubing into the well or well head. The lubricator includes a lubricator pipe element and an associated moveable stripper/packer element adapted to be connected to a well barrier module on the well head.

29 Claims, 10 Drawing Sheets

U.S. PATENT DOCUMENTS

| | | | | |
|---|---|---|---|---|
| 4,940,095 | A * | 7/1990 | Newman | 166/378 |
| 5,244,046 | A | 9/1993 | Council et al. | |
| 5,553,668 | A * | 9/1996 | Council et al. | 166/77.3 |
| 6,116,345 | A * | 9/2000 | Fontana et al. | 166/343 |
| 6,158,516 | A * | 12/2000 | Smith et al. | 166/385 |
| 6,209,634 | B1 * | 4/2001 | Avakov et al. | 166/77.3 |
| 6,386,290 | B1 * | 5/2002 | Headworth | 166/346 |
| 6,609,571 | B2 * | 8/2003 | Nice et al. | 166/342 |
| 6,695,048 | B2 * | 2/2004 | Andersen et al. | 166/77.2 |
| 6,763,889 | B2 * | 7/2004 | Rytlewski et al. | 166/338 |
| 6,763,890 | B2 * | 7/2004 | Polsky et al. | 166/360 |
| 6,834,724 | B2 * | 12/2004 | Headworth | 166/384 |
| 6,843,321 | B2 * | 1/2005 | Carlsen | 166/355 |
| 7,036,598 | B2 * | 5/2006 | Skjærseth et al. | 166/339 |
| 7,114,571 | B2 * | 10/2006 | Gatherar et al. | 166/367 |
| 7,165,619 | B2 * | 1/2007 | Fox et al. | 166/343 |
| 7,182,140 | B2 * | 2/2007 | Wood | 166/379 |
| 7,185,708 | B2 * | 3/2007 | Wood et al. | 166/379 |

FOREIGN PATENT DOCUMENTS

| | | | |
|---|---|---|---|
| GB | 2367079 | A | 3/2002 |
| WO | WO 0161145 | A1 | 8/2001 |
| WO | WO 0220938 | A1 | 3/2002 |

* cited by examiner

ASSEMBLY AND METHOD FOR INTERVENTION OF A SUBSEA WELL

CROSS-REFERENCE TO RELATED APPLICATIONS

This application claims priority to Norwegian patent application 20023178 filed Jun. 28, 2002 and U.S. provisional patent application No. 60/449,613 filed Feb. 26, 2003 and is the national phase under 35 U.S.C. §371 of PCT/IB2003/003084 filed Jun. 30, 2003.

TECHNICAL FIELD

The present invention relates to an assembly for intervention of a subsea well or a well head by means of a wireline or a coiled tubing connected to a tool assembly. The well assembly comprises lubricator means and an injector package. The injector package is adapted to inject the wireline or coiled tubing into the well or well head.

The invention also relates to a method for injecting a wireline or coiled tubing into a subsea well or well head.

The term "well head" shall be interpreted in a broad meaning, and include all equipment normally associated to a subsea well head, such as Christmas tree, tubing hanger, production flowbase (if any) etc. and all equipment associated thereto.

By coiled tubing is meant a continuous and flexible tubing. Said tubing is preferably made of a metallic material or a corresponding material, such as composites.

BACKGROUND OF THE INVENTION

Subsea wells need maintenance and inspection activities at a regular basis. Such activities can be carried out by means of tools delivered to the well via a wire or coiled tubing that extends from a floating vessel or a platform down into the well. Typical maintenance and inspection activities in the well are measurements and monitoring of well conditions, perforating, gravel packing, production stimulation and repair of a downhole completion or production tubing. Today's systems normally use a so-called riser tube, which extends from the vessel to the top of the well head, via which the wire or coiled tubing is fed down into the well. Such systems require restriction of movements between the vessel and the well head due to the configuration of the riser tube. Thereby, the use of such systems becomes difficult, time-consuming and costly.

As an alternative there has been proposed subsea systems that do not use a riser tube for feeding the coiled tubing down to the well, but let the coiled tubing run freely between the vessel and the well head by means of a so-called riserless system. In for example the U.S. Pat. No. 4,899,823 to Cobb et al. there is disclosed such a system, which is provided with a coiled tubing injector for injecting the coiled tubing into the well through the well head and a blow out preventer stack with associated equipment (well pressure barrier section) between the injector and the well head.

The system according to said US-patent is also provided with coiled tubing stripper elements and a well fluid stuffing box carried by the injector via which the coiled tubing is injected into the well head. The blow out preventer stack and the stuffing box may here mainly be considered to function as a lubricator assembly or lubricator means. The well pressure barrier section facilitates the connecting of the coiled tubing to the well head with regard taken to the fluid pressure in the well. Prior to lowering the injector down to the well head the coiled tubing is latched in the injector and preferably also positioned in the stuffing box.

For lowering and retrieval of the injector and the well barrier section, there are provided guide wires that extend from the vessel to the well head. When it is desired to retrieve the injector, it is first operated to withdraw the coiled tubing from the well head. The tubing is locked to the drive chains of the injector and lifted up to the vessel. As the injector is bulky this means that a rather large weight has to be retrieved just for the purpose of withdrawal of the coiled tubing/toolstring to the vessel. This is impractical and thus costly, in particular as multiple toolstrings are commonly used to accomplish the operation objectives.

THE OBJECT OF THE INVENTION

It is an object of the present invention to provide an assembly and a method for intervention of a subsea well or well head that promote an uncomplicated way of handling a coiled tubing or wireline used for delivering tools to the well or well head. The invention shall reduce the costs and the time consumed for handling the coiled tubing, in particular the rig up/rig down time necessary to deploy/retract the coiled tubing/toolstring.

SUMMARY OF THE INVENTION

The object of the invention is achieved by means of the initially defined assembly, characterised in that said lubricator or enclosure means is adapted to be fitted in a lubricator package and define a locking chamber via which said wireline or coiled tubing is to be forwarded to the well or well head; said lubricator means being adapted to be connected to said well head; said injector package, comprising an injector module, being adapted to be fitted to said well head, and that the injector module is adapted to forward said lubricator means through it, when said packages are connected to each other and to the well head, for the purpose of injecting said wireline or coiled tubing into the well or well head.

According to a preferred embodiment of the present invention the well assembly further comprises a well barrier package. The lubricator package is adapted to be fitted onto said injector package; said injector package is adapted to be fitted onto said well barrier package, and said well barrier package is adapted to be fitted onto said well head. The injector module is thus adapted to forward said lubricator means through it, when the lubricator, injector and the well barrier package are connected to each other respectively and to the well head.

The injector module is preferably designed to allow for the passage of the lubricator or enclosure means through it The lubricator means is then used as a pressure locking chamber when the coiled tubing/toolstring is running into or out of the wellhead or well through the injector module. The lubricator means is preferably mainly tube-shaped, thereby being easier to forward through the injector module.

When the coiled tubing/toolstring is to be injected into the well head or well, the lubricator means is forwarded through the injector module and connected to a well barrier module or package at a lower position below the injector module in order to function as a pressure locking chamber. Preferably, at least a part of the length of the lubricator means is forwarded through the injector module, sufficient for it to be connected to the well barrier module or package. The coiled tubing/toolstring is then run down into the well head or well. After the coiled tubing/toolstring has been run down, the lubricator means is retracted to an upper position above the injector module, and the coiled tubing/toolstring is injected into the well by means of the injector module. The coiled tubing is adapted for delivery of one or more tools to the well or well head, said tools being used e.g. for maintenance or repair work therein. When the coiled tubing/toolstring is to be run out of the well head or well the lubricator means is again forwarded through the injector module from its upper position and connected to the well barrier module in order to function as a pressure locking chamber. Thereby, the coiled tubing is preferably being run down or out of the well head or well through the lubricator means.

The coiled tubing/toolstring is preferably rigged up with the upper part of the lubricator package without the need to retract or lift-off the injector package. Thus, the injector package, which is bulky and heavy, does not need to be rigged up together with the coiled tubing/toolstring.

The movement of the lubricator means between the upper position above the injector module and the lower position below the injector module is preferably accomplished by a hydraulic cylinder, or a hydraulically operated screw device.

According to one embodiment of the invention, the well barrier package comprises an upper well barrier module arranged below the injector package, said upper well barrier module preferably being a part of the injector package. According to another embodiment of the invention, the well barrier package also comprises a lower well barrier module or package, which is preferably separately arranged below the upper well barrier package and connected, via a well tree or a Christmas tree adapter package whenever applicable, to the well head.

The inventive assembly comprises a remote-controlled coupling device, preferably arranged in the interface section between the lubricator package and the injector package, for connecting/disconnecting the lubricator means to/from its upper position, i.e. above the injector module/package, and a corresponding coupling device, preferably arranged between the injector module and the well barrier module/package, especially the upper well barrier module, for connecting/disconnecting the lubricator means to/from its lower position, i.e. below the injector module/package.

The injector module preferably comprises at least two driving elements between which the lubricator means is forwarded/retracted and by means of and between which the coiled tubing, after the retraction of the lubricator means through the injector module to its upper position above the injector module, is injected into the well head or well. The spacing between said driving elements is adjustable so as to engage the driving elements and the coiled tubing in order to inject the coiled tubing/toolstring during the injecting operation of the injector module. Preferably, said driving elements are extended in the axial direction of the injector package/module, and arranged opposite each other. The two driving elements are preferably fitted to the framework of the injector package by a sliding arrangement so that they can be operated sideways by hydraulic or electric power to leave room for the lubricator means as well as to engage the coiled tubing for the purpose of injecting the coiled tubing/toolstring into the well head or well during the injecting operation of the injector module.

The lubricator or enclosure means preferably comprises a lubricator pipe element, a fixed stripper/packer element that is arranged in the upper part or end of the lubricator pipe element, and an associated moveable stripper/packer element. The moveable stripper/packer element is adapted to feed and retract the coiled tubing together with the tool assembly or toolstring through the lubricator pipe when the lubricator pipe preferably is in its lower position, i.e. connected to the well barrier module/package. Each of said element is preferably sealingly arranged around the coiled tubing and between itself and the lubricator pipe element.

The moveable stripper/packer element preferably remains in place at and locked to the coupling device of the well barrier module while the lubricator pipe element is retracted to said upper position in order to hold the coiled tubing in a fixed position before it is to be injected by means of the injector module.

The inventive assembly is based on operation from a floating vessel at the sea surface, preferably a dynamically positioned light intervention vessel or a drilling oil rig/ship, and is designed to operate a wireline or coiled tubing on vertical or horizontal Christmas trees. For the lubricator to be adapted to operate a wireline instead of a coiled tubing, the upper part of the lubricator package including stripper elements is replaced with a wireline sealing device, preferably a stuffing box. Thus, the conversion from coiled tubing to wireline operation and vice versa may easily be performed. Accordingly, the combination of wireline and coiled tubing operation is also within the scope of the present invention, which makes it possible to cover the majority of all required intervention tasks.

The floating vessel comprises means including a surface injector, which is heave compensated, and an associated coiled tubing reel for feeding out the coiled tubing from the vessel and for retracting the same to the vessel. The coiled tubing is freely extending in the water with a tension defined by the system between the surface injector and the injector module. The slack of the coiled tubing and the tension thereon is controlled and maintained by the surface injector and associated reeling mechanism means on the coiled tubing reel. However, there should preferably be provided guide wires extending from the vessel to the well head for the purpose of guiding the modules/packages of the assembly during deployment and retrieval thereof. In addition, especially at large depths, a running tool is preferably used.

The floating vessel, injector package and the wireline or coiled tubing extending between them preferably form a passive system that permits substantial movement of the vessel in relation to the well head.

The object of the invention is also achieved by means of the initially defined method for injecting a wireline or coiled tubing into a subsea well or well head, comprising the steps of: connecting an injector package, having an injector module for injecting the wireline or coiled tubing into the well or wellhead, to the well head; forwarding lubricator means adapted to be fitted in a lubricator package, through the injector module when said packages are connected to each other and to the well head; connecting said lubricator means defining a locking chamber via which the coiled tubing is forwarded to the well or well head, to the well head; and injecting said wireline or coiled tubing by means of the injector module into the well or well head. According to a preferred embodiment of the inventive method a well barrier package is further connected onto the well head; the injector package is connected onto the well barrier package; the lubricator package is connected onto the injector package; and that the lubricator means is forwarded through the injector module when said packages are connected to each other and to the well head.

The coiled tubing is connected to a toolstring or tool assembly in order to deliver one or more tools to the well or well head for maintenance and/or repair work therein.

The lubricator means is thus preferably forwarded/retracted via an opening in the injector module to the well barrier package. In a preferred embodiment of the present invention, the coiled tubing is forwarded through a lubricator pipe element of the lubricator means when it has been forwarded through the injector module and connected to the well barrier package/module. The coiled tubing/toolstring is thus forwarded through said connected lubricator pipe element, and connected to the well barrier package or generally to the well head. The lubricator pipe element can be moved through the injector module without any need of disconnecting the injector package from the well head.

After the coiled tubing/toolstring has been run into the well the lubricator pipe element is disconnected and retracted through the injection module such that it is displaced in relation thereto, enabling the injector module to grip the coiled tubing by means of driving elements and commence injecting the coiled tubing/toolstring into the well The lubricator pipe element is here preferably retracted to an upper position above the injector module.

The injector is also used for retracting the coiled tubing/toolstring from the well. Before the tubing is disconnected from the well head the lubricator pipe element is forwarded from its retracted position and once again connected to well barrier package in order to operate as a locking chamber. After retracting the toolstring into the lubricator preferably by means of the above mentioned surface injector of the floating vessel, and closing the well barrier module (deployment valve) located below the injector module, the lubricator pipe element is flushed or cleaned from possible well fluids and contamination etc. that has entered into it during the operation, and then run to its upper position. The toolstring is then preferably retracted with the top part of the lubricator package.

The coiled tubing and the lubricator package may either be removed as one single unit or separately from the injector package connected via the well barrier package to the well head.

The coiled tubing is arranged with a constant tension or a tension defined by the system, extending from the surface injector of the floating vessel to the injector module or the well head.

Wires or the like are arranged between the vessel and the well head or the different packages/modules of the well assembly, i.e. the injector package/module, the lubricator package and the well barrier package/module for guiding them in order to fit the separate packages/modules to each other onto the well head. The coiled tubing may also be guided by means of said wires.

BRIEF DESCRIPTION OF THE DRAWINGS

The invention will now be explained more closely by the following detailed description of different preferred embodiments thereof with reference to the appended drawings, on which.

DETAILED DESCRIPTION OF THE INVENTION

Figure 1:
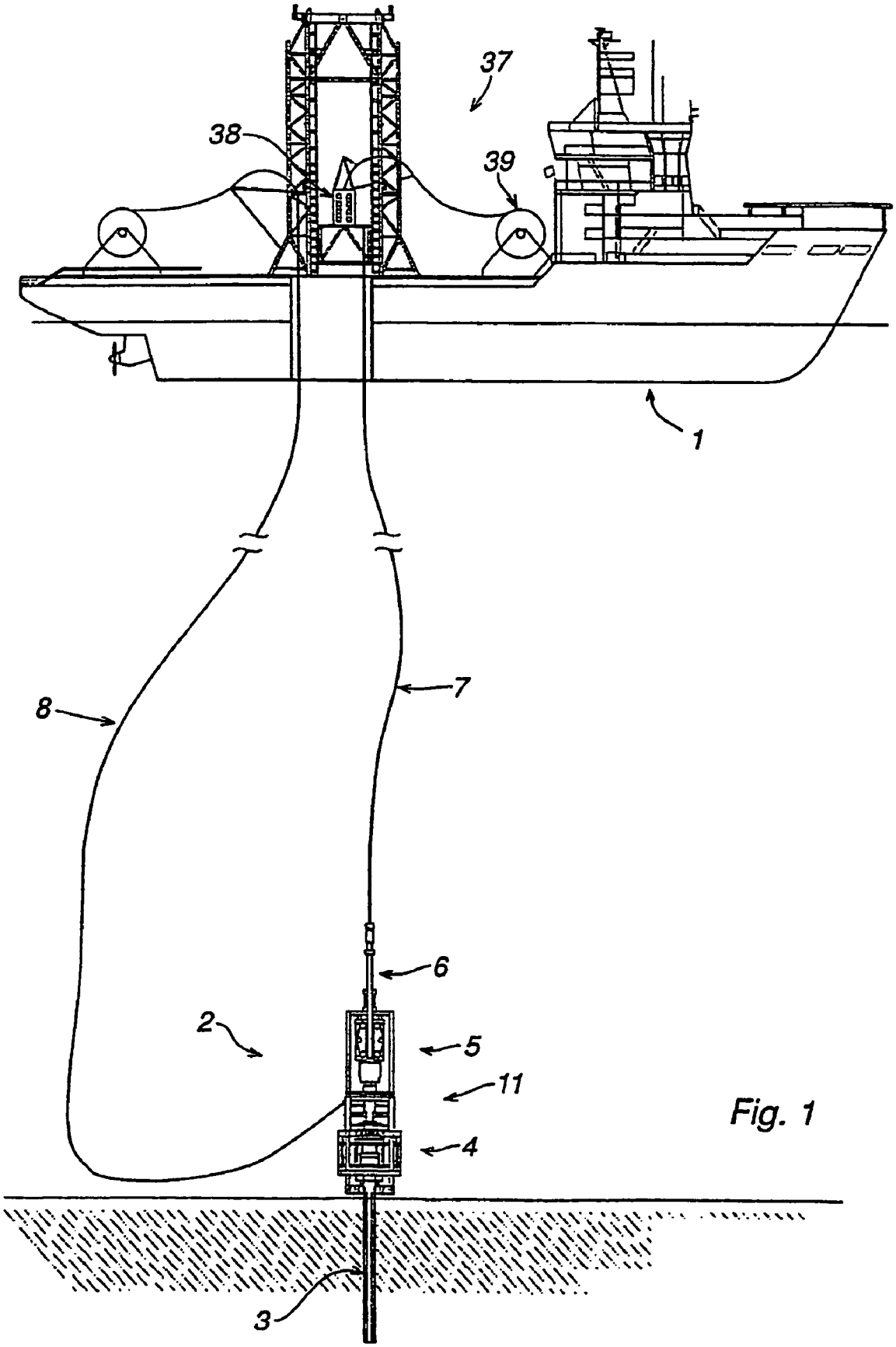
FIG. 1 is a schematic view of a system for intervention of a subsea well including a dynamically positioned intervention vessel and an assembly according to the invention.

FIG. 1 shows a system for intervention of a subsea production well including a dynamically positioned light intervention vessel 1 and an assembly according to a preferred embodiment of the invention. The assembly 2 is connected via a Christmas tree adapter package to the Christmas tree of the well head 4 located at the seabed, and comprises a coiled tubing injector package 5, a coiled tubing lubricator package 6 and a well pressure barrier package 11. The lubricator package 6 comprises a lubricator or an enclosure means defining a pressure locking chamber through which a coiled tubing 7 is to be forwarded to the well head as will be explained more in detail below. The lubricator package 6, the injector package 5 and the well barrier package 11 of the well assembly are adapted to and arranged onto each other respectively. The coiled tubing 7 is adapted for delivery of one or more tools to the well 3, said tool(s) being used for maintenance and repair work therein. The well assembly is also connected to an umbilical or control cable 8 extending from a reel on the vessel to the well assembly 2 for the supply of electrical and hydraulic power, chemical fluids, and for transmission of electrical signals needed during the intervention operation.

The vessel 1 is equipped with a derrick with sufficient height and strength to handle the different packages. The derrick will have guide wire winches with constant tension and a lifting winch with a compensation arrangement for handling the packages. The vessel is also provided with a surface injector 38 adapted to be arranged in the derrick, and an associated coiled tubing reel 39 for feeding out the coiled tubing 7 from the vessel and for retracting the same to the vessel.

Figure 2:
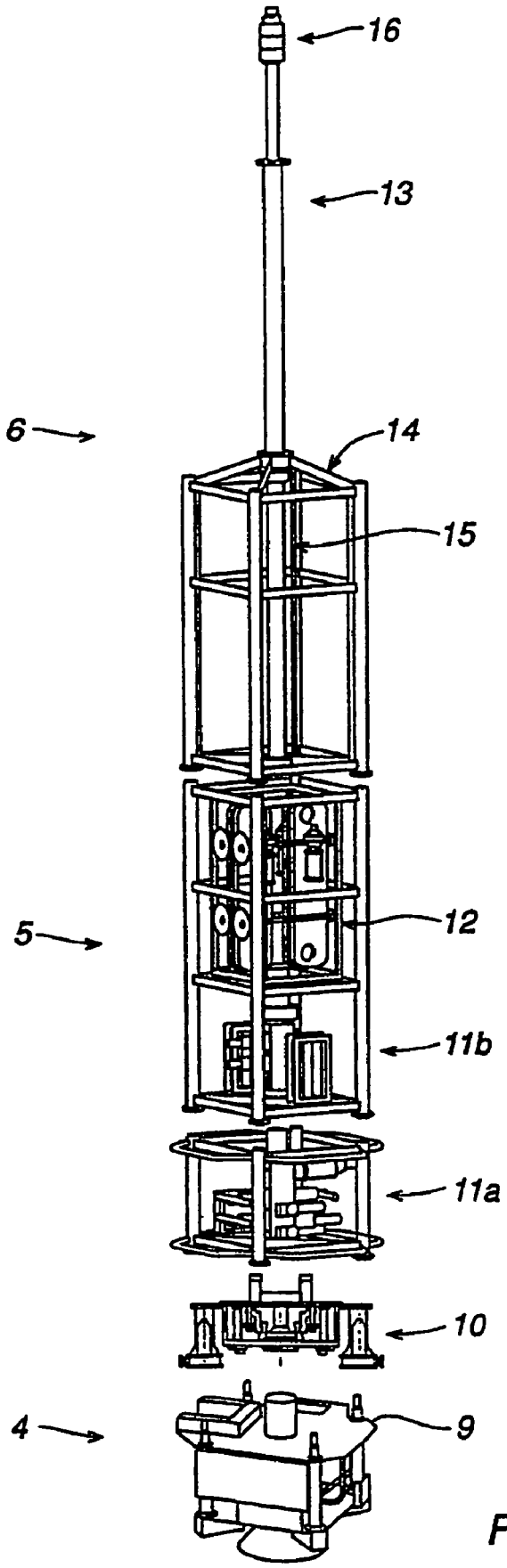
FIG. 2 is an exploded schematic view of the inventive assembly, connected to a subsea Christmas tree, according to one embodiment of the invention.

FIG. 2 shows an exploded schematic view of the assembly 2 according to one embodiment of the invention, whereby the assembly comprises a lower well pressure barrier package 11*a*, an injector package 5 (including an upper well pressure barrier module 11*b*), and a lubricator package 6. During assembling of the packages, each package is lowered down from the vessel towards the seabed, landed on top of each other and firmly connected both structural and functional to the Christmas tree/wellhead in the order as shown in FIG. 2. One or more packages may alternatively be assembled together at the surface on the vessel before lowering them down.

For the above purpose, guiding wires are used extending, preferably through guide funnels or the like of the frameworks of the packages, between the wellhead and the vessel. At large depths a running tool is used instead or in addition. The Christmas tree is of a usual type well known by the skilled person and, therefore, not further discussed here. The barrier package 11*a*, comprises in general blow out preventer (BOP) stack, arranged below the injector module/package, and includes a number of valves, and a control pod with all electric/electronic functions to operate the complete subsea system during the intervention operation. The control umbilical 8, which can be remotely connected/disconnected, is here connected to the pod. The blow out preventer stack should preferably, in addition to its valves, be provided by means for various forms of well circulation (e.g. during production stimulation of the well) by connecting passages or bypasses such as hoses or risers to the stack, whereby possible pressure increase in the well may be controlled. The well barrier package 11 has the same function and type of equipment as a lower workover riser package (LRP) of a conventional system. Furthermore, there are hydraulic and electric couplers (not shown) between the Christmas tree and the well barrier package making it possible to control the functions of the Christmas tree and downhole safety valve during intervention.

As shown in more detail in the embodiment according to FIG. 2, the injector package 5 comprises a separate, self-standing injector module 12 adapted for the purpose of passing the lubricator through it as well as, during the injecting operation of the injector module, injecting the coiled tubing 7 into the well 3, and the upper well pressure barrier module 1 lb. The lubricator package 6 comprises a tubular body in the form of a lubricator pipe element 13 (surrounded by a protection casing as indicated in the figure) with an upper end 16, and a mechanical screw device 15 for the purpose of passing the lubricator pipe element 13 through the injector module 12.

Figure 3:
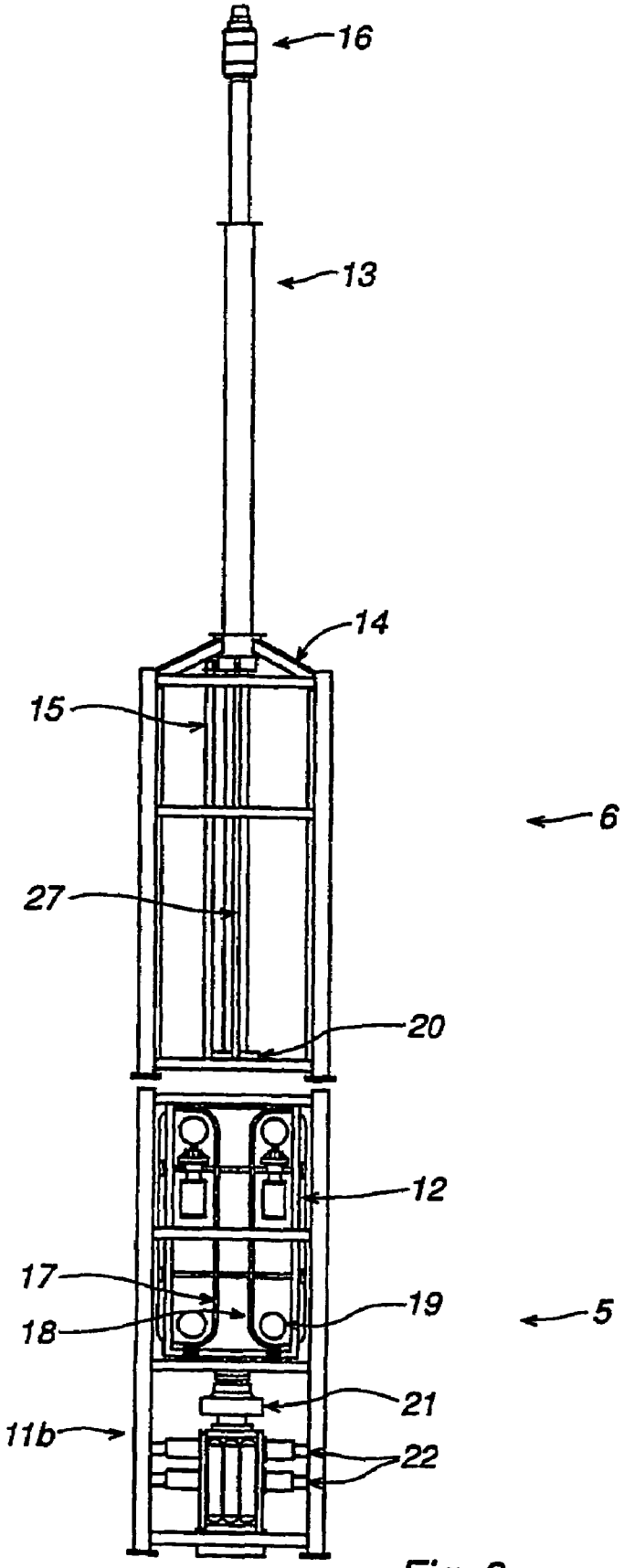
FIG. 3 is a partly cut side-view of a part of the embodiment according to FIG. 2, including a so-called coiled tubing lubricator package and an injector package.

As shown in FIG. 3, the injector module 12 comprises at least two opposed driving elements 17, 18. extending in the axial direction of said module, between which the lubricator pipe element 13 is forwarded/retracted. The driving elements are fitted to the framework of the injector module by a sliding arrangement so that they can be operated sideways by hydraulic or electric power to leave room for the lubricator pipe as well as to engage with the coiled tubing. In this way, the spacing between said driving elements 17, 18 may be adjustable to allow for lubricator pipes or tubes with varying dimensions to pass through the injector module 12 with or preferably without engagement to the driving elements 17, 18. According to one embodiment of the invention, the diving elements 17, 18 include endless bands or belts arranged on rotating wheels or shafts 19 driven by hydraulic or electric motors/gears (not shown). Instead of endless bands or belts any other suitable arrangement may be used. For example, rotating wheels or shafts may be arranged to be in direct engagement with the coiled tubing 7. Further, for example, each of the driving elements may have coiled tubing grippers connected to an endless chain that is driven by a hydraulic or electric motor/gear. A hydraulic force thereby gives friction between the coiled tubing and the grippers in order to accomplish the injection of the coiled tubing/toolstring into the well during the injecting operation of the injector module. The top and bottom of the driving elements have a guiding arrangement to guide the coiled tubing into the grippers when the driving elements are operated towards each other. The framework of the injector module is resting on load cells, as indicated in FIG. 3, connected to the main fame of the injector package for measurement of the coiled tubing push and pull force.

When the lubricator pipe is to be passed or forwarded through the injector module 12, the driving elements 17, 18 are operated sideways to an outer position, the lubricator pipe element 13 is run down through the module 12, and entered into the coupling device 21, here in the form of a multiconnector, to establish i. a. connection/disconncetion to the upper well barrier package 11*b* and the well head 4. After pressure controlling, testing of various seals and opening of appropriate valves (gate valve, ball valve etc.) of the well barrier package and well head, the injecting operation is started in order to inject the coiled tubing/toolstring to the well 3.

According to a preferred embodiment of the invention the lubricator pipe element 13 is forwarded through the injector module 12 by means of a dedicated screw device 15 including guiding rods and jacking screw(s). The screw device 15 is arranged inside the framework of the lubricator package 6.

The assembly is provided with remote-controlled coupling devices 20, 21 preferably arranged at the interface sections of the lubricator/injector package and the injector/upper well barrier package respectively. In particular, the coupling device 20 (only partly shown in FIG. 3) is a multiconnector arranged in the interface section between the injector package 5 and the lubricator package 6, and has a hydraulic coupler to connect/disconnect the lubricator package to/from the injector package, and hydraulic and electric couplers for all the functions on the lubricator package, such as connecting/disconnecting and sealing the lubricator pipe element 13 in its upper position above the injector module. The coupling device or multiconnector 21, comprises a lower and an upper part. The lower part has a large hydraulic operated coupler to connect/disconnect, seal and lock the injector package 5 to the well barrier package (blow out preventer stack 22) and in the same operation preferably connect all hydraulic and electric functions between these two packages. The upper part of the multiconnector 21 has two hydraulically operated couplers, one coupler to connect/disconnect, seal and lock the lubricator pipe element to the multiconnector 21 during forwarding/retraction of tools, and the other to connect/disconnect, seal and lock a main stripper/packer element 30 (see FIG. 5) to the multiconnector 21 during coiled tubing operation. In addition, the upper part of the multiconnector 21 also includes a hydraulically operated mechanism for activating the main stripper element 30.

From the above it should be understood that the lubricator pipe element comprises a connector device, which is preferably remote-controlled and arranged at its lower end for connecting the lubricator pipe element 13 to the corresponding coupling device, i.e. the multiconnector 21 seated on the stripper BOP stack 22 of the upper well barrier package 11*b*, and for disconnecting the lubricator pipe 13 from said multiconnector 21.

Figure 4:
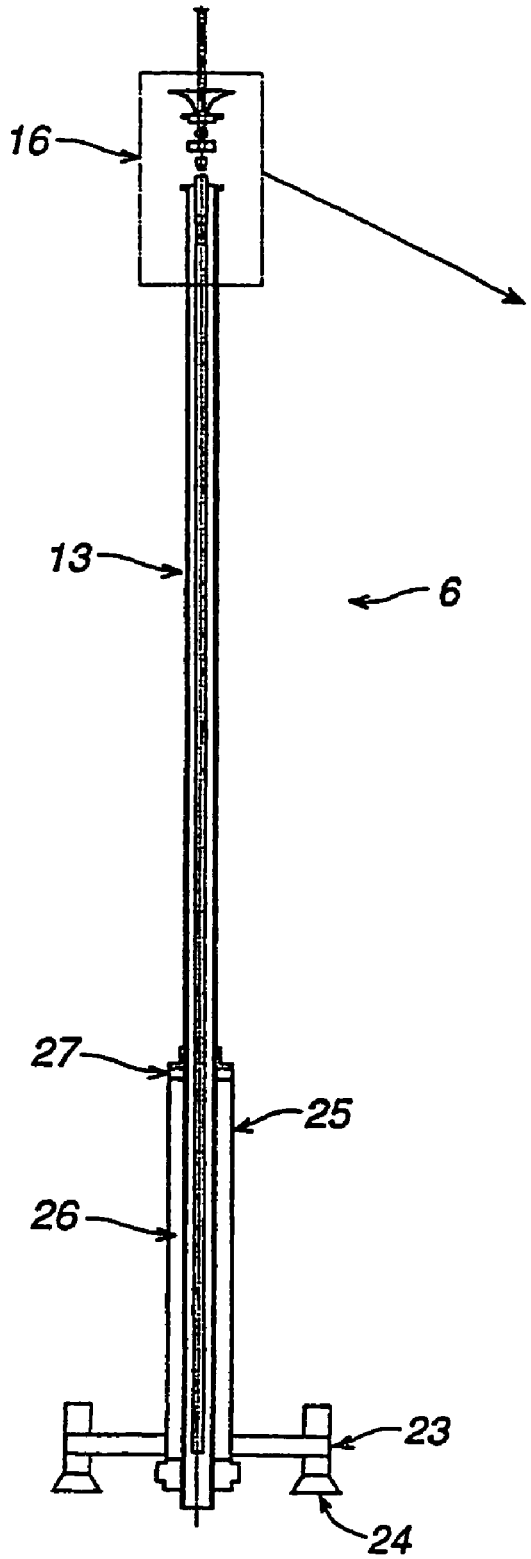
FIG. 4 is a side-view of a part of the coiled tubing lubricator package according to another embodiment of the invention (corresponding to FIG. 1)

FIG. 4 separately shows another preferred embodiment of the lubricator package 6, which is connected to the injector package 5 and via the coupling device 21 of the injector package to the lower well barrier package 11*a*. The generally tubular body of the lubricator pipe element 13 is displaceable in relation to its framework 23 (including guide funnels 24 etc.) in a direction to/from the injector module 12 of the injector package 5. The lubricator pipe element 13 can be displaced so as to be forwarded/retracted through the injector module 12 down to the coupling device 21 arranged on the top of the stripper BOP stack 22 of the upper well barrier package 11*b*. At the lower part of the lubricator package 6, a hydraulic cylinder device 25 is fixedly attached to the framework of the lubricator package 6 through which the lubricator pipe element 13 extends via sealed ends of the cylinder device 25. The lubricator pipe element 13 has a ring-shaped piston or an annular flange 27, the outer periphery of which generally corresponds to the inner periphery of the cylinder device 25. Thereby, the inner periphery of the cylinder element 25, said flange and the outer periphery of the lubricator pipe element 13 delimit a space 26. The lubricator package 6 preferably comprises means (not shown) for supplying a pressure medium, such as a hydraulic fluid, into the space 26 and removing the same from the space 26 in order to move the piston 27 and thereby the lubricator pipe element 13 in relation to the injector module 12. By means of the hydraulic cylinder device 25 it is also possible to move the coiled tubing 7 to and from engagement with the injector module 12. The mechanical screw device 27 (as indicated in FIG. 3) for forwarding/retracting the lubricator pipe element 13 to engage with the coupling device 21 of the upper well barrier package 11*a* will here serve as primary or back up so as to allow for the pressure medium to act as described above. The length of the lubricator pipe element may be about 15 m, which is typically a standard length. It may be made up of one piece of pipe or a number of pipes. The diameter of the lubricator pipe may preferably be of a standard dimension, such as 179 mm and 187 mm, enabling receipt of standard types of tools being used during intervention. Further, as should be understood, the length of the lubricator pipe element to be forwarded/retracted through the injector module 12 is adapted for connection/disconnection to/from the coupling device 21 and depends on the axial dimension (height) of the injector module/package. A typical length in a preferred embodiment is about 5 m.

Figure 5:
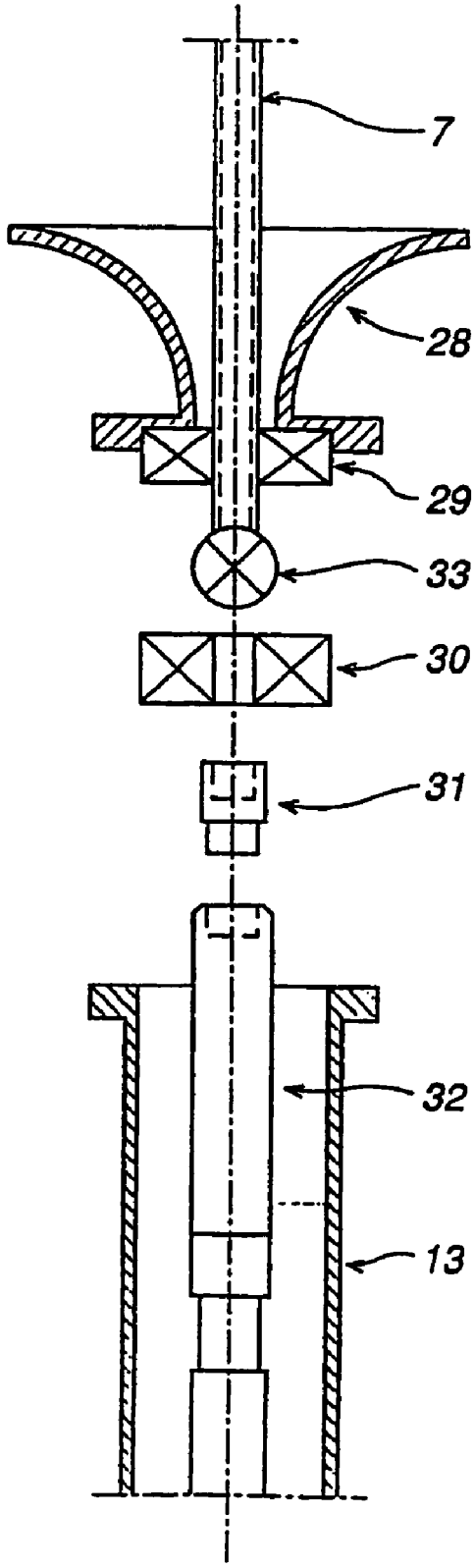
FIG. 5 is an exploded cross section of a top part of the lubricator package of FIG. 4 for receiving a tool assembly connected to a coiled tubing, FIGS. *6a-6f* are schematic side views showing the main steps being perform in order to injected the coiled tubing/tool assembly into the well head according to the inventive method.

FIG. 5 is an exploded view and shows an embodiment of the upper part or end 16 of the lubricator package 6. The lubricator package has a top funnel 28 enabling the coiled tubing/toolstring to be easily introduced therein. A stationary or fixed stripper/packer element 29 is connected to the bottom of the guide funnel 28 and is sealingly engaged thereto and around the lubricator pipe 13 and the coiled tubing 7, which extends through the guide funnel 28 and the fixed stripper/packer element 29. Accordingly, the fixed stripper/packer element 29 seals the lubricator pipe 13 at its upper end, when the pipe 13 is pressurised, during in and out pressure lockage of tools through the well barrier package 11 and valve tree 9. The upper part of the lubricator package 6 also comprises a second moveable stripper/packer element 30 for deployment into a stripper bowl (not shown), and a coiled tubing connector 31 for connecting the coiled tubing 7 to the toolstring 32 that is to be introduced into the well head/well. The moveable stripper/packer element 30 is the main seal element during the intervention operation. This stripper/packer element 30 is inserted, preferably on the floating vessel, into the lubricator pipe together with the toolstring and seals around the coiled tubing and between itself and the lubricator pipe 13, thereby it prevents well fluid to leak out to the sea water. The moveable stripper/packer element 30 is used for running the tool/toolstring down 32 through the lubricator pipe 13.

Thus, the lubricator means comprises a lubricator pipe 13, a fixed stripper/packer element 29, and the associated moveable stripper/packer element 30, and works as a pressure locking chamber for passing the coiled tubing/toolstring into the well head/well through the lubricator pipe 13, which then is connected at its lower position below the injector module 12 to the coupling device 21 of the upper well barrier package 11*b*.

The fixed stripper/packer element 29 is dismounted from the lubricator pipe 13, preferably on the vessel, when tools have to be inserted or exchanged; The upper part of the lubricator package 6 may also be provided with a ball valve 33 if the coiled tubing has to be cut (cutting ball valve).

FIGS. 6*a-f* schematically show by way of example the main operation steps of the method being performed of the inventive assembly for injecting the coiled tubing 7 and the tool/toolstring 32 in a subsea well 3 via a horizontal Christmas tree 9. Said tree is of a usual type having a production passage and an annulus passage with associated valves respectively. The assembly comprises the lower well barrier package 11*a*, the injector package (with the upper well barrier module 11*b*), and the lubricator package 5. The upper well barrier package 11*b* comprises a so-called dual stripper BOP 22 (here as a stripper secondary primary and a stripper backup element. The lower well barrier package 11*a*, comprises a so called tripple BOP. The tripple BOP includes (seen from the top downwardly) a gate valve 34, a shear ram, and a pipe ram. The gate valve 34 is an isolation valve to open and close the access to the well for each tool run in and out of the wellhead/well. The shear ram is used for cutting off tools or coiled tubing. The pipe ram is a valve for sealing around the coiled tubing and is used to grip around it, preventing the tool(s) from falling downwardly in the well, if the coiled tubing suspending the tool(s) has to be cut. It should be noted that additional such valves may be present and arranged in another order than the ones mentioned above. Furthermore, the lower well barrier package 11*a* may have connection for flexible hoses/pipes up to the surface for so-called well return or killing purposes. The well is completed by a production tubing having a downhole safety valve 35, in accordance with standard practice.

Before starting the intervention operation the cap of the Christmas tree 9 is removed. During normal production the tree cap having a crown plug located in its internal serves as an outer, secondary barrier of the Christmas tree 9. All of the valves in the Christmas tree 9 are, or will thereby be closed. According to one embodiment of the invention, the lower well barrier package 11*a* and the injector package 5 will be skidded into the derrick and stacked up as a unit (see FIG. 1). The umbilical is connected to the unit, and after complete testing of the unit it is lowered down to the Christmas tree 9 by means of a running tool. After landing of the unit on the Christmas tree it will be attached and locked thereto, via an adapter 10 that may be included in the unit as well, and tested. According to another preferred embodiment, the packages 5, 6, 10 and 11*a* may also be run down and installed as separate units or in any suitable combined combination, e.g. the lower well barrier package 11*a* may be a part of the Christmas tree adapter 10. Thereafter, the coiled tubing lubricator package 6 will be skidded into the derrick and lowered down into the moon-pool of the vessel 1. The tool string 32 will then be made up, lowered into the lubricator pipe 13 and hanged off in a frame. The coiled tubing surface injector 38 will be skidded into the derrick and the coiled tubing connected to the toolstring by means of the coiled tubing connector 31 (as shown in FIG. 5) The coiled tubing upper section 16 will then be fitted to the lubricator pipe 13 and the lubricator package is ready to be lowered down to the seabed. The lowering is executed by feeding out tubing by means of the surface injector 38. After landing the lubricator package 6 on the injector package, they will be hydraulically locked together and tested so as to complete the installation of the well assembly 2.

Figure 6A:
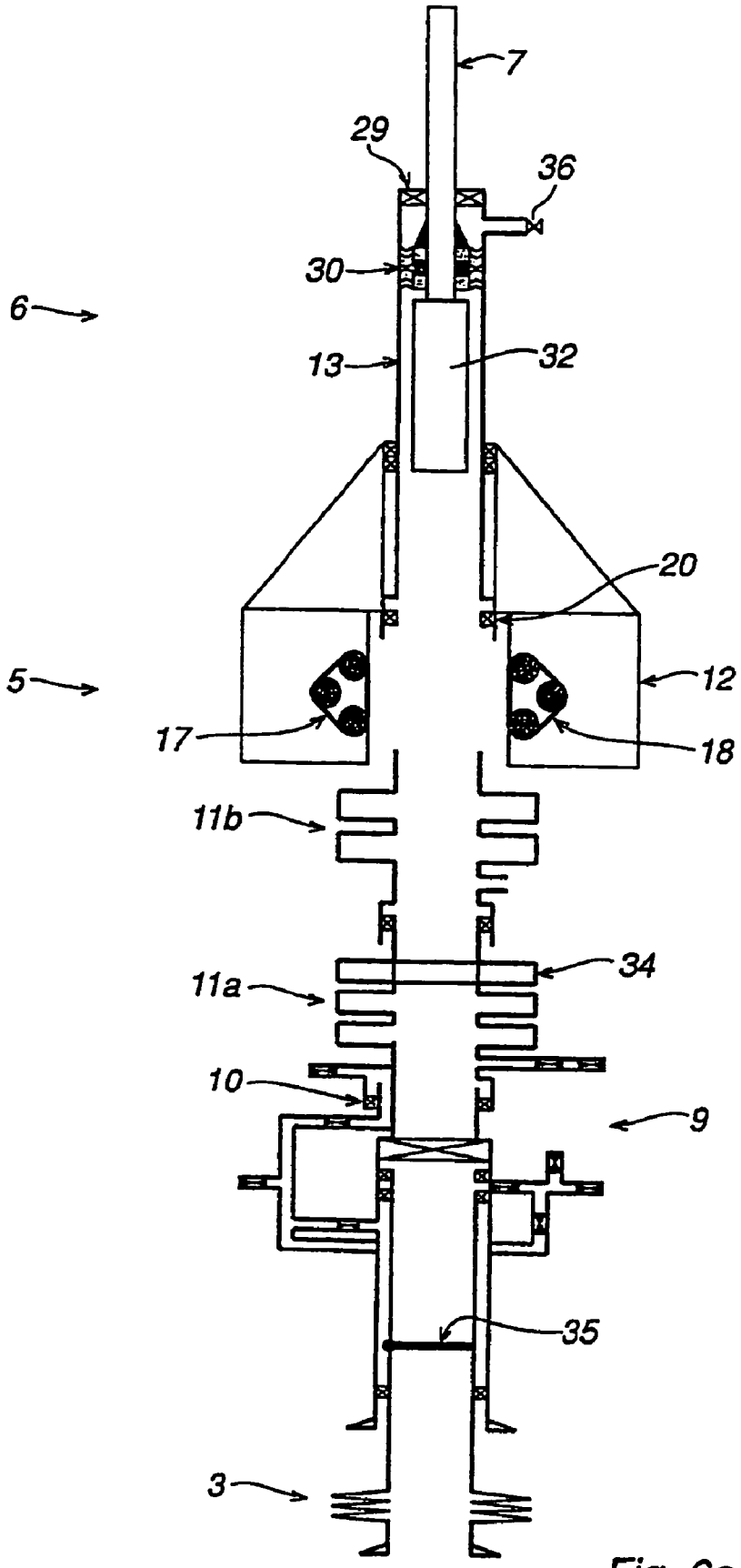

FIG. 6*a* shows the starting position of the intervention operation with the lower end of the coiled tubing 7, located at the upper part of the lubricator package 6, suspending the toolstring 32 inside the lubricator pipe 13. The moveable main stripper/packer element 30 will be activated so as to seal around the coiled tubing 7 during its movement together with the assembled tool 32 down through the lubricator pipe 13. As shown in FIG. 6*a*, the main stripper/packer element 30 comprises an upper part and a lower part. The (outside) upper part will act as a pipe plug for pumping the main stripper element 30 down through the lubricator pipe. The (outside) lower part is for connecting and sealing the lubricator pipe 13 in its lower position (see FIG. 6*d*). The driving elements 17, 18 of the injector module 12 are separated enough by operating them sideways to an outer position for permitting the lubricator pipe element 13 to be run down through the injector module 12.

Figure 6B:
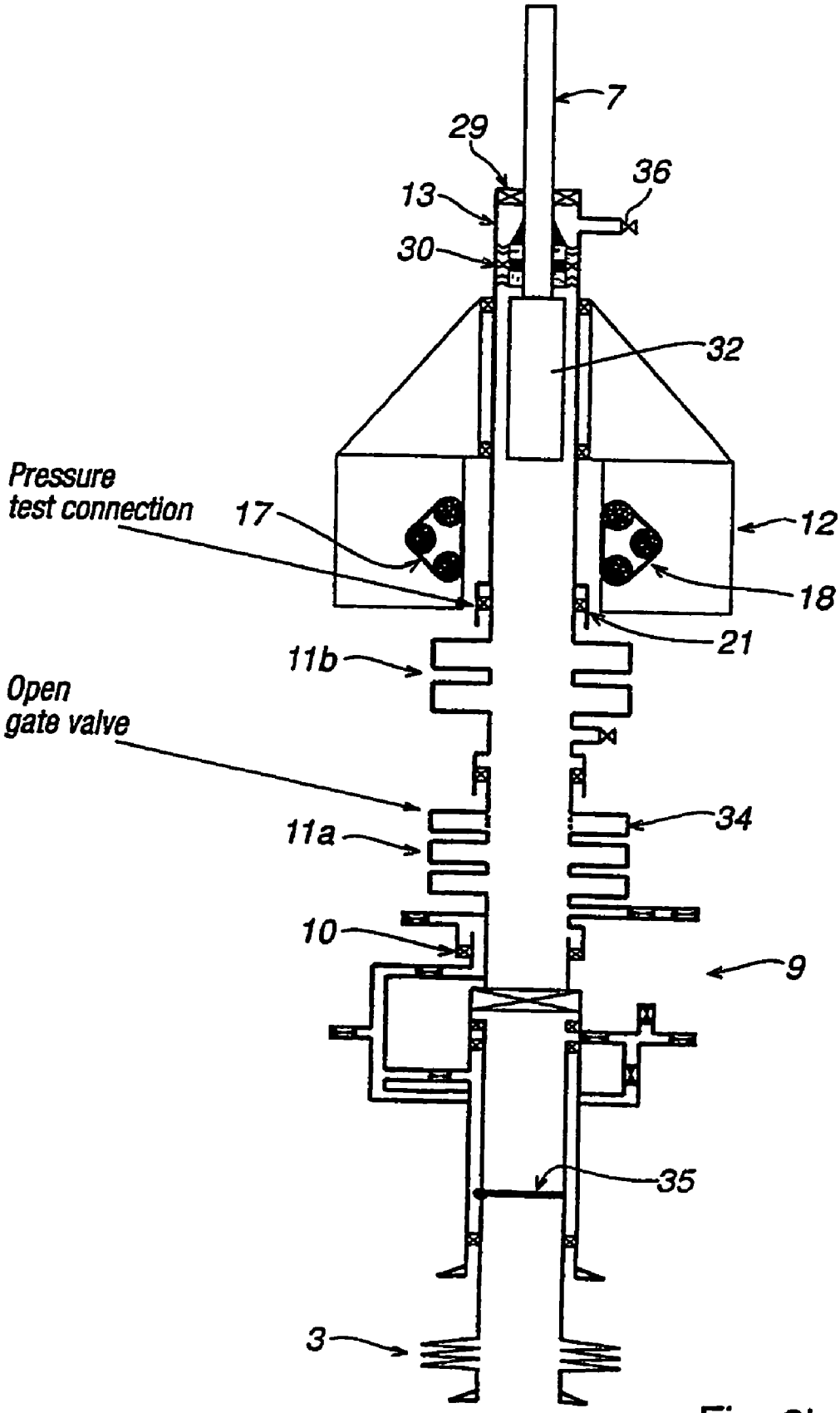

In FIG. 6*b*, the lubricator pipe 13 has been run down through the injector module 12, and a connector device arranged at the lower end of the lubricator pipe has entered into the multiconnector 20 of the upper well barrier package 11*b*. Said multiconnector 20 is arranged at the interface section of the lubricator package 6 and the injector package 5. The movement of the lubricator pipe 13 is accomplished by the operation of a mechanical screw device (not shown) fitted inside a framework as schematically indicated above the injector package 5. The multiconnector 21 is seated onto the stripper BOP 22 of the upper well barrier package 11*b*. The connector device of the 5 lubricator pipe 13 is then connected/locked to the corresponding connector device of the multiconnector 21 on top of the stripper BOP 22. A complete pressure test of the assembly will now be performed in order to equalize the pressure with the well pressure, and the gate valve is opened.

Figure 6C:
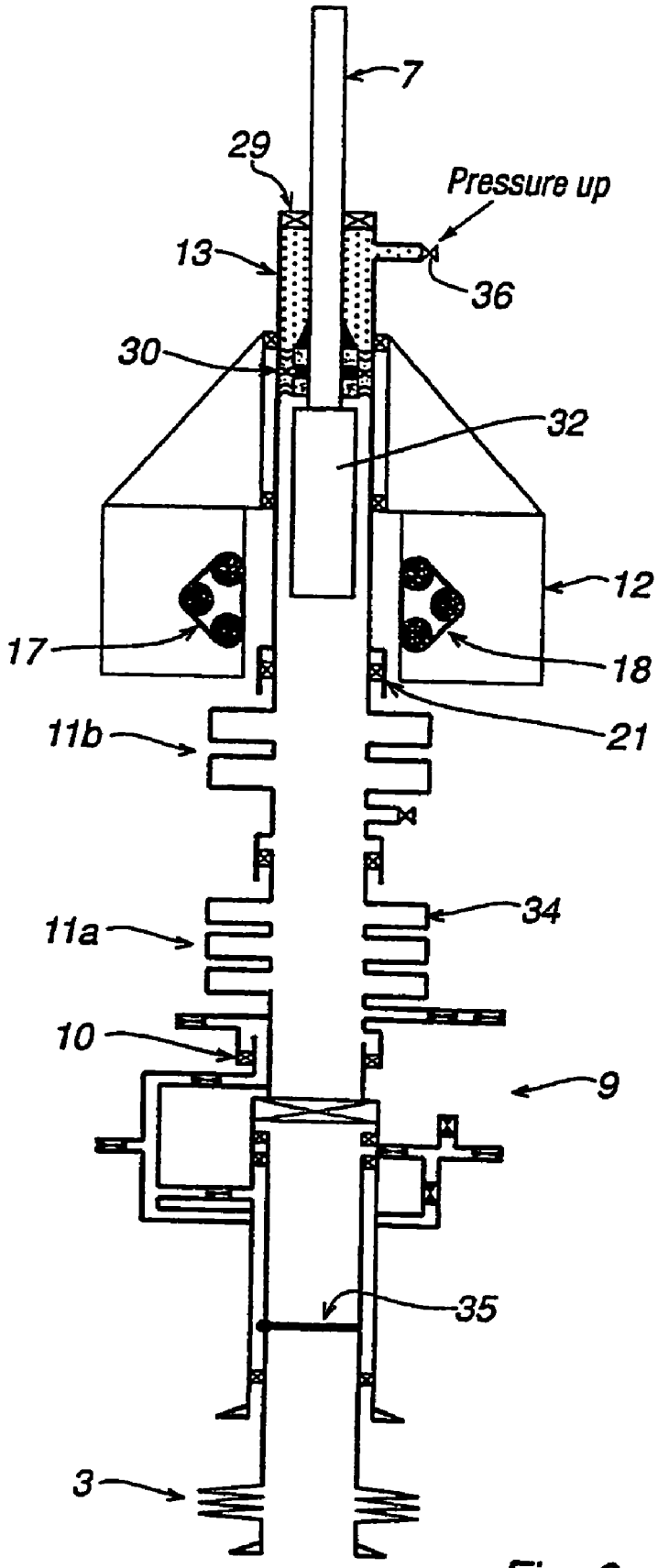

After said pressure testing, the valves of the Christmas tree 9 will be opened. The above mentioned Christmas tree adapter 10 here comprises passages for supply of hydraulic fluid into the valves in the tree 9, whereby these may be opened and closed during the intervention process. In FIG. 6*c*, a pressure medium is introduced into the lubricator pipe via valve 36 above the main stripper element 30, resulting in that said element 30 and tool 32 being forced down through the lubricator pipe 13 towards the multiconnector 21 of the upper well barrier package 11*b*.

Figure 6D:
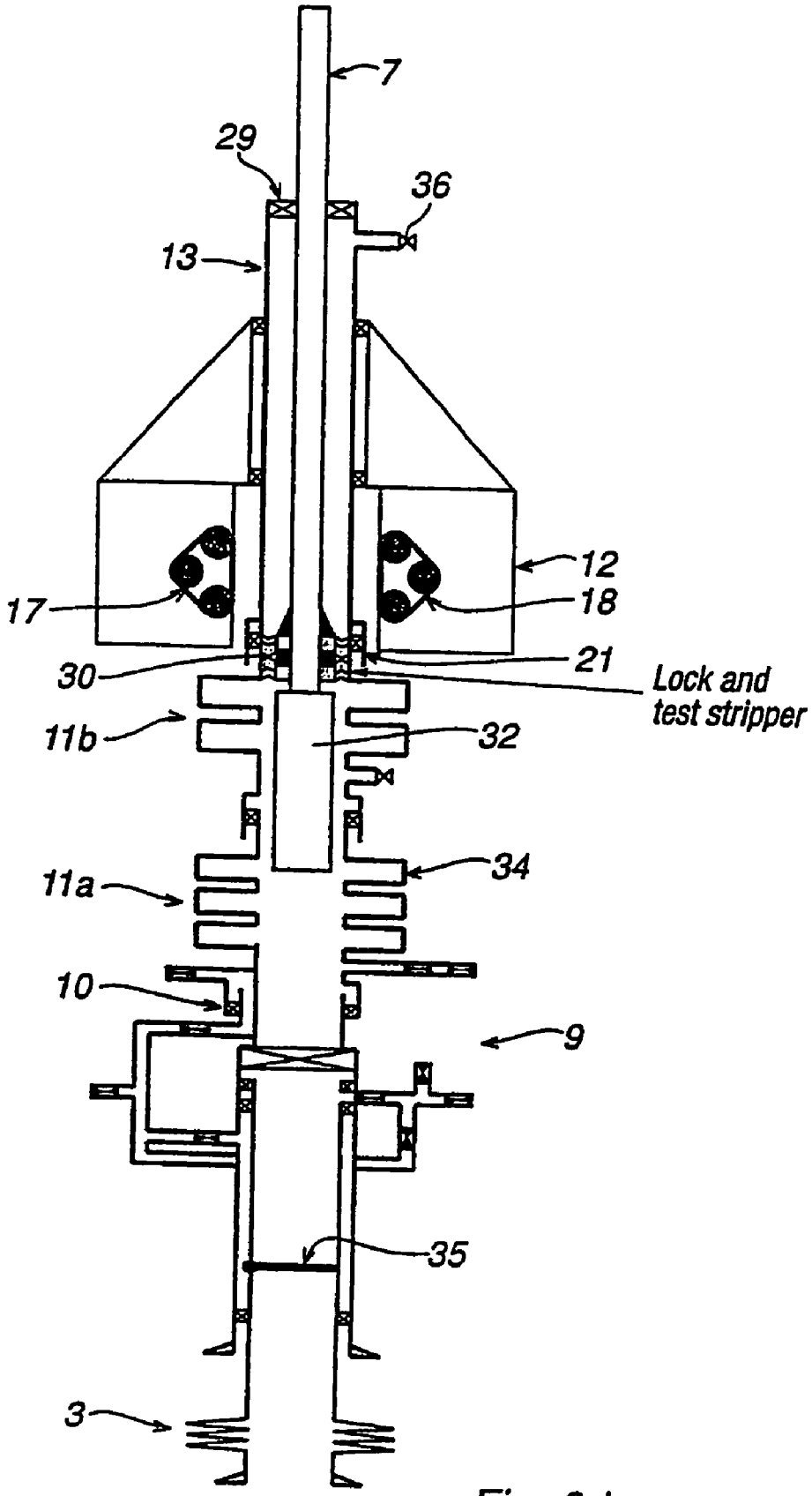

In FIG. 6*d* the coupling device of the main stripper element 30 has been entered into engagement with the corresponding coupling device of the multiconnector 21. The main stripper element 30 is locked and tested, and the stripper/packer of said element is activated. Thereby the lubricator pipe 13, the fixed stripper/packer element 29, and the main stripper/packer element 30 works as a tubular locking chamber via which said coiled tubing is to be run down into the well head and well. Once the tool 32 is introduced into the well head 4, the pressure above the main stripper element in the lubricator pipe is bled off in order to check the multiconnector 21 and coiled tubing 7. The lubricator pipe 13 will then be flushed/cleaned from well fluid and contamination that has entered therein during the operation.

Figure 6E:
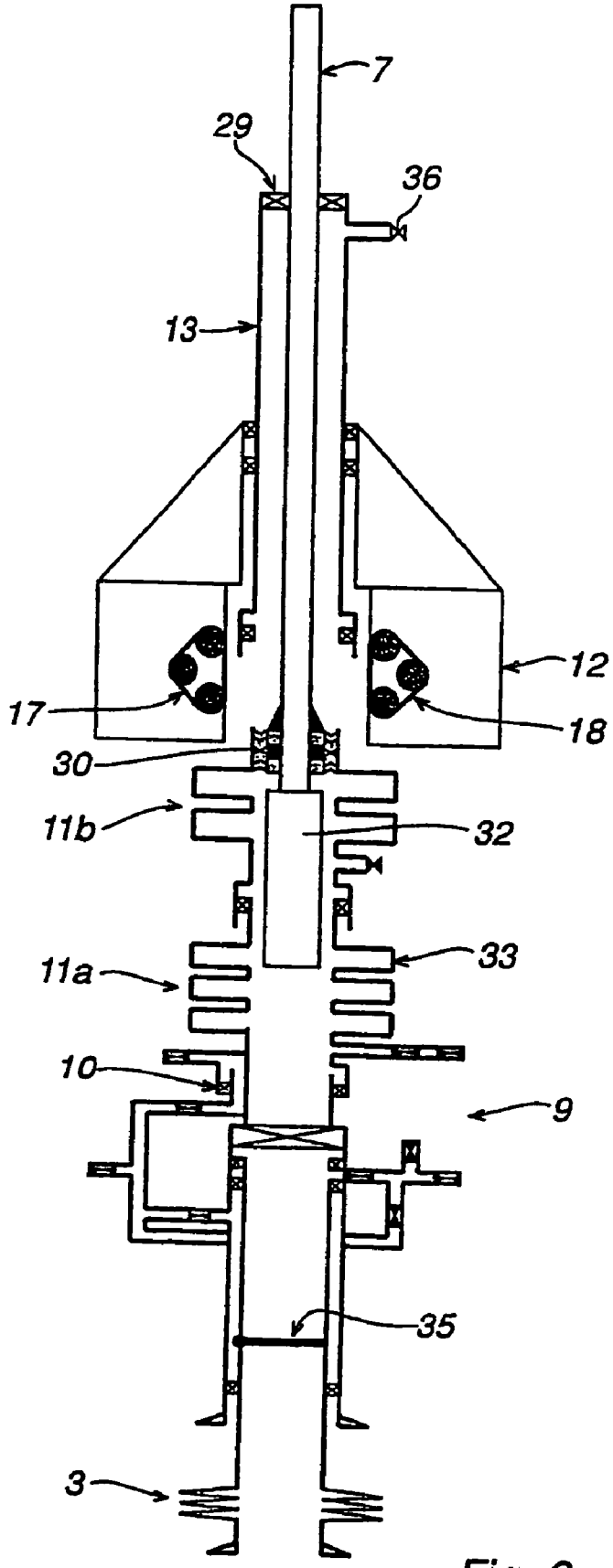

The coupling of the lubricator pipe 13 is then released and the lubricator pipe 13 is running to an upper position, as shown in FIG. 6*e*, above the injector module 12 by means of the mechanical screw device and/or activation of the pressure medium in the space 26 (see FIG. 4) of a cylinder device 25 (in case such a device is used) and/or the driving elements 17, 18 of injector module 12.

Figure 6F:
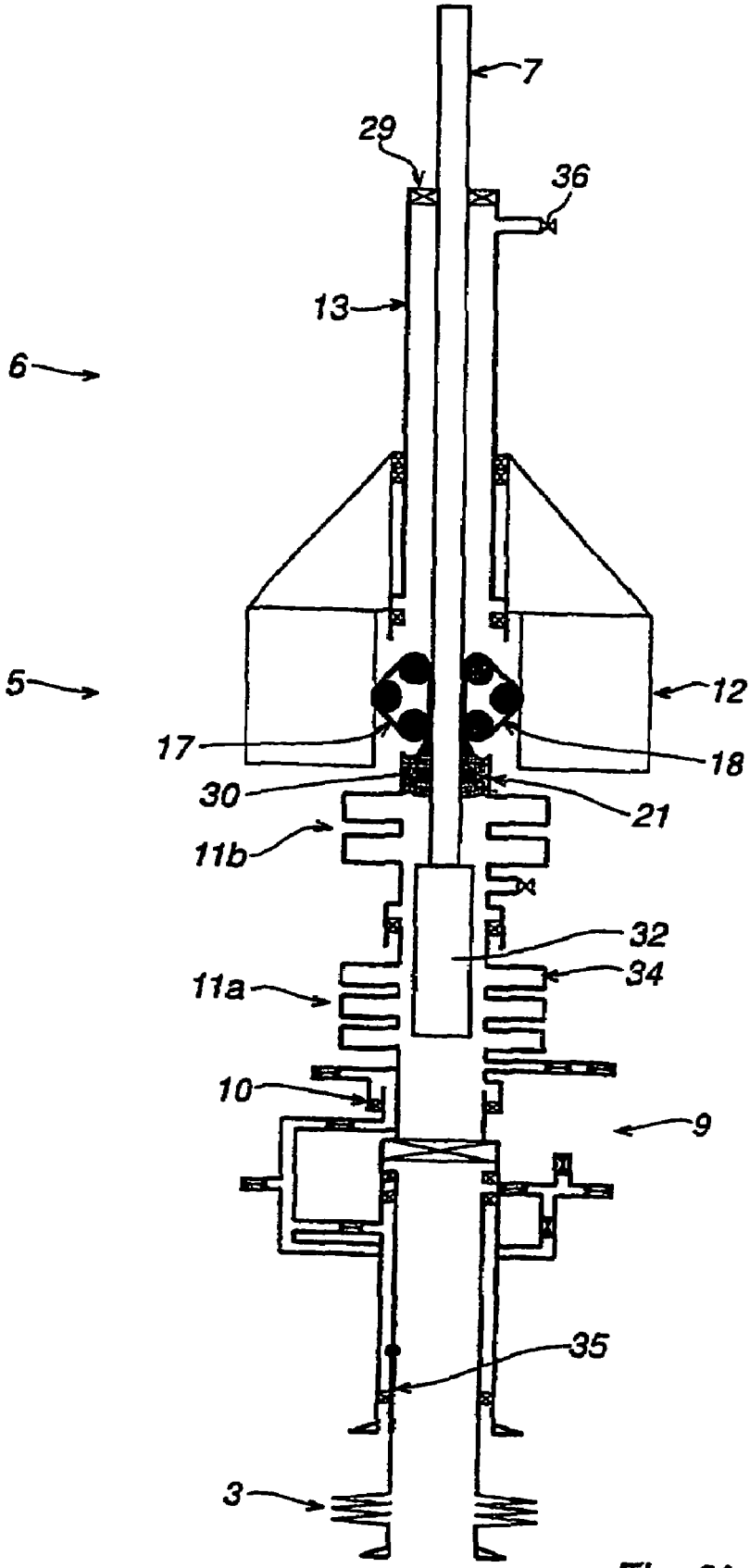

As shown in FIG. 6*f* the lubricator pipe 13 has been positioned above the injector module 12. The downhole safety valve 35 will now be opened and the coiled tubing injector module 12 starts to operate. The driving elements 17, 18 of the injector module 12 are thus moved into engagement with the coiled tubing 7 and the injecting operation is started for injecting the coiled tubing and the tool down into the well head and well.

For the removal of the coiled tubing 7 and the tool 32 out of the well, the steps described above are performed in the reverse order. Here the driving elements 17, 18 are used to pull the coiled tubing 7 and the tool 32 out of the well until it is withdrawn up to the main stripper/packer element 30. The driving elements 17, 18 are then moved aside and the lubricator pipe 13 is forwarded and locked to the multiconnector 21 in its lower positions and pressurised. The main stripper/packer element and the tool are then run up through the lubricator pipe, and the valves of the well barrier package can be closed. The pressure in the lubricator pipe is drained and the pipe is flushed clean from well fluid and so on.

The coiled tubing (or wireline) 7 is connected to the floating vessel 1 and is freely extending in the water with constant tension between the vessel 1 and the injector module 12. The inventive well assembly comprises means 37 for controlling an intake of the coiled tubing 7 to the vessel and means for a corresponding feeding out of the coiled tubing from the vessel. The vessel 1, injector package 5 and the coiled tubing 7 extending between them form a passive system that permits substantial movement of the vessel 1 in relation to the well head 4, which thereby e.g. reduces the time to position/prepare the vessel for intervention of the subsea well. This is, of course, nevertheless important with regard to the crude conditions that often may prevail off-shore. Other advantages with the assembly according to the invention are reduced rigging time and thereby reduced costs for subsea interventions. The inventive assembly makes it also possible to handle coiled tubing of greater length. Further, it does not require anchor handling, which is difficult especially in areas with large populated seabed.

The assembly is suitable for all kind of water depth applications, i.e. for shallow, medium as well as for deep water applications. Subsea intervention operations with the inventive assembly are typically performed at water depths in the interval 800 to 3000 m.

It should be realised that the invention has been shown by way of example by means of the above described embodiments. A number of alternative embodiments will therefore be obvious for a person skilled in the art without going beyond the scope of the invention as defined in the appended claims supported by the description and the annexed drawings.

The invention claimed is:

1. A well assembly for intervention of a subsea well or a well head with a wireline or a coiled tubing connected to a tool or a toolstring, the well assembly comprising:

an injector package adapted to inject the coiled tubing into the well or well head, said injector package comprising an injector module being adapted to be fitted to the well head, and a lubricator adapted to be fitted in a lubricator package and define a locking chamber via which said wireline or coiled tubing is to be forwarded to the well or well head, said lubricator being adapted to be connected to said well head, said lubricator comprising a lubricator pipe element and an associated moveable stripper/packer element adapted to be connected to a well barrier module on the well head, wherein the moveable stripper/packer element is adapted to feed and retract the coiled tubing together with the tool or toolstring through the lubricator pipe element, wherein the injector module is adapted to forward said lubricator through the injector module when said injector package and said lubricator package are connected to each other and to the well head to inject said coiled tubing into the well or well head.

2. The well assembly according to claim 1, further comprising a well barrier package being adapted to be fitted onto said well head, wherein said injector package is adapted to be fitted onto said well barrier package, wherein said lubricator package being adapted to be fitted onto said injector package, and wherein the injector module is adapted to forward said lubricator through the injector module when said well barrier package, said injector package and said lubricator package are connected to each other and to the well head.

3. The well assembly according to claim 1, wherein the injector package comprises a separate injector module through which of the lubricator is forwarded.

4. The well assembly according to claim 1, wherein the lubricator package comprises a hydraulic cylinder device for forwarding and retracting the lubricator through the injector module between an upper position above the injector module and a lower position below the injector module.

5. The well assembly according to claim 1, wherein the lubricator package comprises a mechanical screw device for forwarding and retracting the lubricator through the injector module between an upper position above the injector module and a lower position below the injector module.

6. The well assembly according to claim 1, wherein the well barrier package comprises an upper well barrier module arranged below the injector package.

7. The well assembly according to claim 6, wherein the well barrier package also comprises a lower well barrier module or package arranged below the upper well barrier module.

8. The well assembly according to claim 1, further comprising a remote-controlled coupling device for connecting/disconnecting the lubricator at an upper position, and a corresponding coupling device for connecting/disconnecting the lubricator at a lower position.

9. The well assembly according to claim 1, wherein the injector module comprises at least two driving elements by and between which the coiled tubing, after the retraction of the lubricator through the injector module, is injected into the well or well head, the spacing between said driving elements being adjustable so as to engage the driving elements and the coiled tubing during the injecting operation of the injector module.

10. The well assembly according to claim 1, wherein the lubricator further comprises a fixed stripper/packer element that is arranged in an upper part or end of the lubricator pipe element.

11. The well assembly according to claim 10, wherein each of the fixed stripper/packer element and the moveable stripper/packer element is sealingly arranged around the coiled tubing and between itself and the lubricator pipe element.

12. The well assembly according to claim 1, wherein said moveable stripper/packer element is adapted to be placed either in an upper position above the injector module with a coupling device, or to the well barrier module in a lower position below the injector module with the coupling device.

13. The well assembly according to claim 12, wherein the moveable stripper/packer element remains in place at the coupling device of the well barrier module while the lubricator pipe element is retracted to said upper position.

14. The well assembly according to claim 1, wherein the coiled tubing is connected to a floating vessel that comprises a feeder and retractor configured to feed out the coiled tubing from the vessel and retract the coiled tubing to the vessel, the feeder and retractor comprising a surface injector and an associated coiled tubing reel.

15. The well assembly according to claim 14, wherein the coiled tubing is freely extending in the water with a tension defined by the system between the surface injector and the injector module.

16. The well assembly according to claim 1, wherein the vessel, injector package and the wireline or coiled tubing extending between the vessel and the injector package form a passive system that permits substantial movement of the vessel in relation to the well head.

17. A method for forwarding a wireline or coiled tubing connected to a tool or a toolstring into a subsea well or well head, the method comprising:

connecting an injector package, comprising an injector module for injecting the coiled tubing into the well or wellhead, to the well head, forwarding a lubricator adapted to be fitted in a lubricator package, through the injector module when the injector package and the lubricator package are connected to each other and the well head, said lubricator comprising a lubricator pipe element and an associated moveable stripper/packer element which is adapted to be connected to a well barrier module on the well head, feeding and retracting the coiled tubing and tool or toolstring through the lubricator pipe element with the moveable stripper/packer element, connecting said lubricator defining a locking chamber via which wireline or the coiled tubing is forwarded to the well or well head, connecting the moveable stripper/packer element to said well barrier module, retracting the lubricator pipe element through the injector module, and injecting said coiled tubing with the injector module into the well or well head.

18. The method according to claim 17, further comprising:

connecting a well barrier package onto the well head, connecting said injector package onto the well barrier package, connecting said lubricator package onto the injector package, and forwarding said lubricator through the injector module when said well barrier package, said injector package, and said lubricator package are connected to each other and to the well head.

19. The method according to claim 18, further comprising:

forwarding the wireline or coiled tubing through the lubricator and connecting the wireline or coiled tubing to the well head when the lubricator has been connected to the well barrier package.

20. The method according to claim 19, further comprising:

disconnecting the lubricator from the well barrier package and retracting the lubricator through the injection module such that it is displaced in relation to the injection module when the coiled tubing has been connected to the well head.

21. The method according to claim 20, further comprising:

utilizing the injector module for injecting the coiled tubing with driving elements into the well when the lubricator has been retracted.

22. The method according to claim 17, further comprising:

utilizing the injector module for retracting the coiled tubing out of the well.

23. The method according to claim 18, further comprising:

forwarding the lubricator from a retracted position and connecting the lubricator to the well barrier package before the coiled tubing is disconnected from the well head.

24. The method according to claim 17, further comprising:

removing or disconnecting the coiled tubing and the lubricator package as a single unit or separately from the injector package.

25. The method according to claim 17, further comprising:

arranging the coiled tubing with a tension defined by the system, extending from a surface injector to the injector module.

26. The well assembly according to claim 3, wherein the separate injector module is self-standing.

27. The well assembly according to claim 5, wherein the mechanical screw device is hydraulically operated.

28. The well assembly according to claim 6, wherein the upper well barrier module is a part of the injector package.

29. The well assembly according to claim 8, wherein the remote-controlled coupling device is arranged in an interface section between the lubricator package and the injector package, and wherein the coupling device is arranged in an upper well barrier module.

* * * * *